US007017907B2

(12) United States Patent
Labetti

(10) Patent No.: US 7,017,907 B2
(45) Date of Patent: Mar. 28, 2006

(54) CHESS TO THE SECOND POWER

(76) Inventor: Walter Labetti, 27 Ave. J, Monroe Township, NJ (US) 08831

( * ) Notice: Subject to any disclaimer, the term of this patent is extended or adjusted under 35 U.S.C. 154(b) by 0 days.

(21) Appl. No.: 10/885,831

(22) Filed: Jul. 6, 2004

(65) Prior Publication Data

US 2006/0006595 A1 Jan. 12, 2006

(51) Int. Cl.
*A63F 3/00* (2006.01)

(52) U.S. Cl. ..... 273/260; 273/290

(58) Field of Classification Search ..... 273/290, 273/260, 261; D21/388; 271/260, 261, 271/290

See application file for complete search history.

(56) References Cited

U.S. PATENT DOCUMENTS 1,472,657 A * 10/1923 Lillard ..... 273/290

* cited by examiner

*Primary Examiner*—Vishu K. Mendiratta
(74) *Attorney, Agent, or Firm*—Kenneth Watov; Watov & Kipnes, P.C.

(57) ABSTRACT

An improved chess-like game. The game uses a traditional chess board and basically the same rules. The additional second set of pieces and some rule changes enhances the game. There's a time limit to strategically place the secondary pieces inside of the primary pieces and placed on the board. Primary pieces for each player are the same as traditional chess. Secondary pieces include the same pieces as traditional chess except there is no king. When a primary piece is taken it is removed from the game, the secondary piece is removed from the primary then placed in the same square it was occupying with its primary piece. The piece that took the primary piece returns to the square it was in before advancing. Castling is the same. Using En passant, all pawns can be taken. Only primary pawns have the option of moving two squares on the first move.

4 Claims, 2 Drawing Sheets

CHESS TO THE SECOND POWER

CROSS-REFERENCED TO RELATED APPLICATION

Not Applicable

FEDERALLY SPONSORED RESEARCH

Not Applicable

SEQUENCE LISTING OR PROGRAM

NOT Applicable

BACKGROUND OF THE INVENTION—FIELD OF THE INVENTION

This invention is a board game, specifically related to the traditional game of chess.

BACKGROUND OF THE INVENTION

The traditional game of chess has its limits. There is no strategy in the placement of pieces at the beginning of the game. At the start of every game, all the pieces are placed in the same order. During the game, all the pieces and their positions are known to each player. The strategy of the game is limited to the pieces and the rules of classic chess.

BACKGROUND OF THE INVENTION—OBJECTS AND ADVANTAGES

Accordingly, several objects and advantages of my present invention are:

(a) added strategy by strategically placing a set of secondary pieces inside of the primary pieces, (b) add challenges as the primary pieces convert to their secondary piece, (c) added pieces—each player in addition to the traditional set of chess pieces receives a set of secondary pieces which are: eight pawns, two castles, two knights, two bishops and one queen, (d) added rules: in addition to the rules governing traditional chess there are a few rules added to this game:

(e) added level of play: playing Chess to the Second Power has more features compared to classic chess, by setting up the game, remembering where the secondary pieces were placed, adapting to a changing playing field and calculating your opponent's secondary piece strategy, (f) added to this game is an aspect of luck. A player at the same or different skill level as their opponent could get lucky. When a primary piece is taken it puts its secondary piece in play. This has the potential of putting the opponent at a disadvantage, check or checkmate.

SUMMARY

Chess to the second power has an additional set of secondary pieces and a few added rules that are combined with classic chess to form a new game.

DRAWINGS—FIGURES

DRAWINGS—REFERENCE NUMERALS

23 primary piece
24 lower portion of secondary piece
23A primary piece
23B hidden view of space inside primary piece
24A top portion of secondary piece
24B lower portion of secondary piece

DETAILED DESCRIPTION

Figure 1:
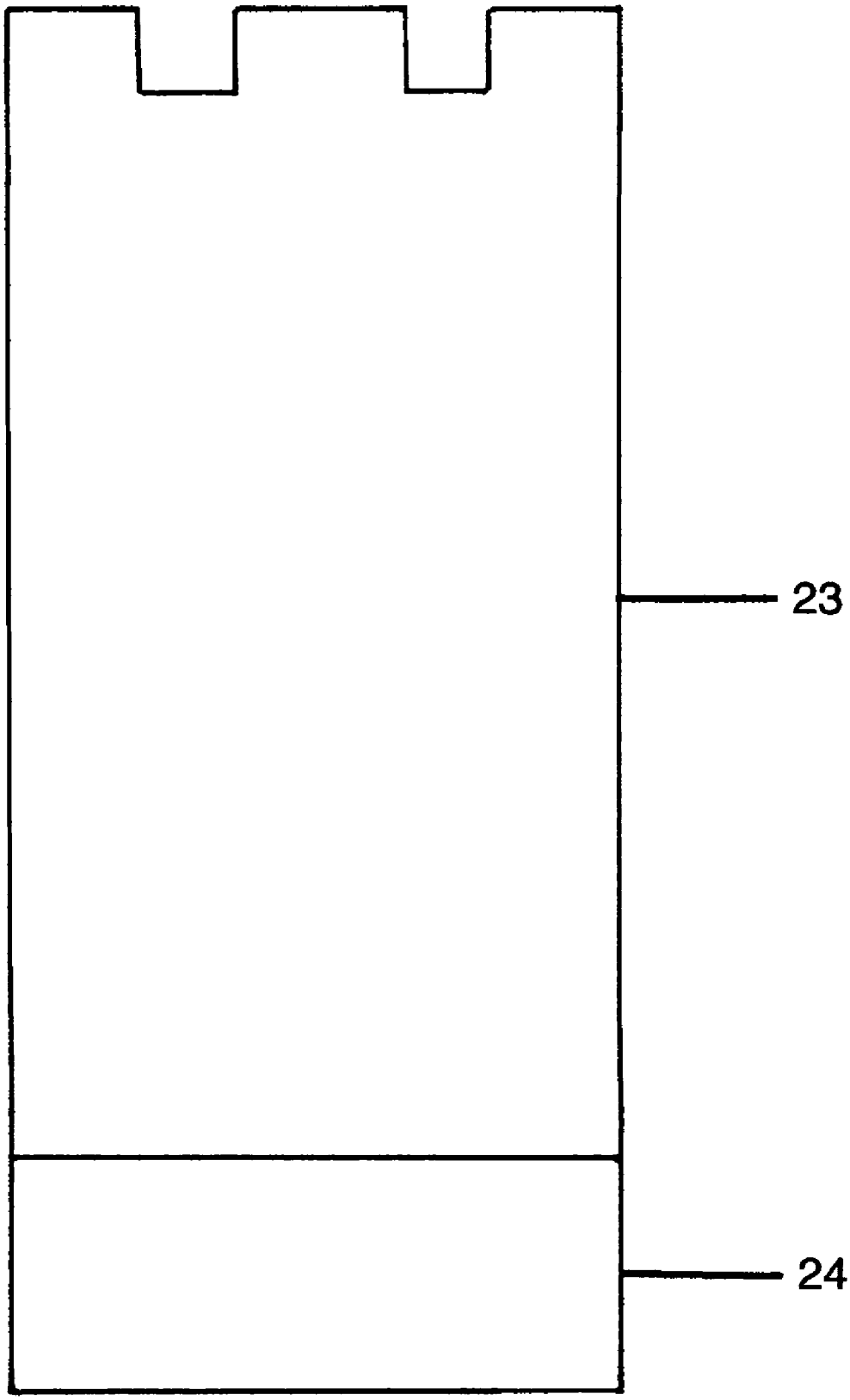
FIG. 1, is a side view showing a primary piece resting on the lower part of the secondary piece.
Figure 2:
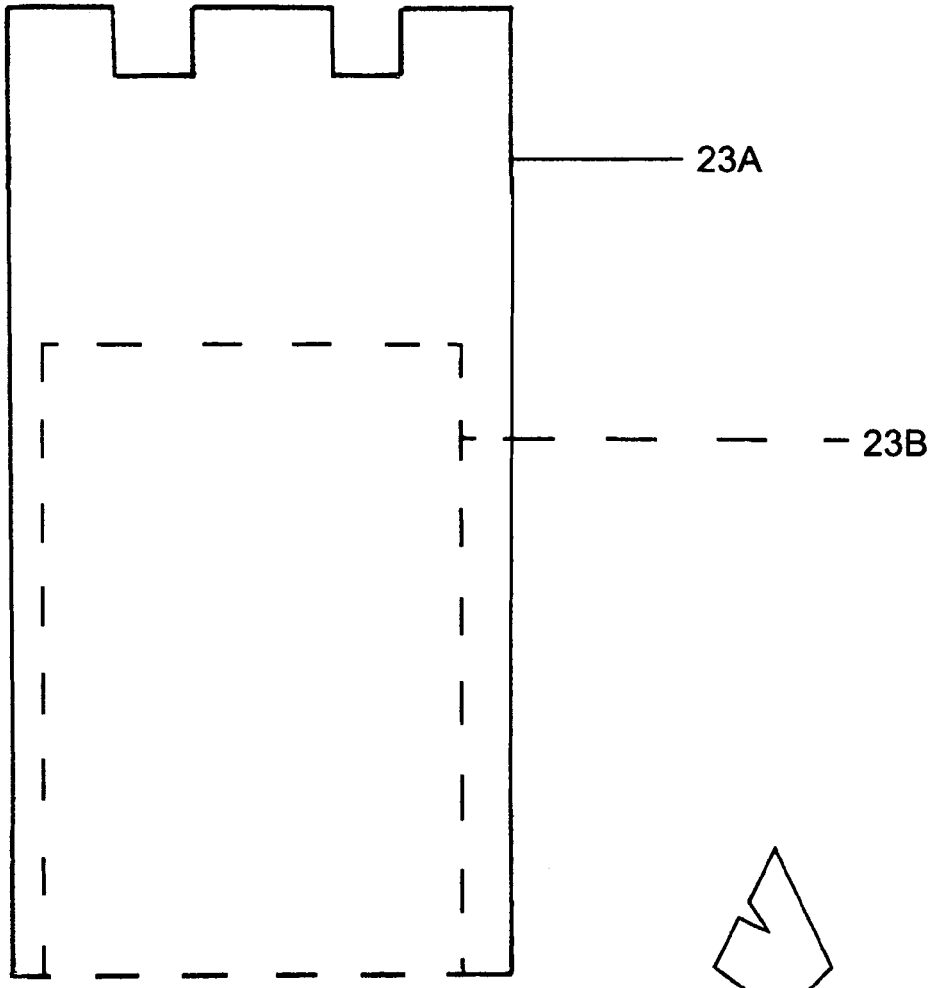
FIG. 2, is a side view showing a primary piece with a hidden space inside.
Figure 3:
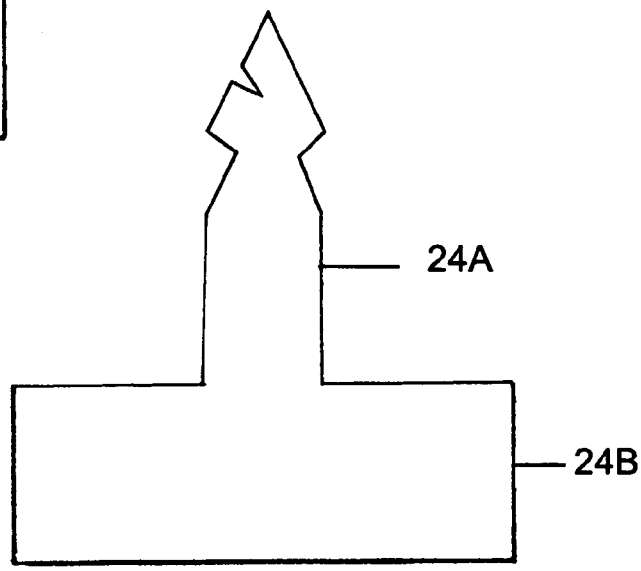
FIG. 3, is a side view showing a secondary piece.

Preferred Embodiment FIGS. 1, 2, and 3.

This game is played on a traditional chess board that has the correct dimensions to support the size of the inventions pieces. The following is a way to create this game. For the primary pieces, wooden dowels, one and one quarter inch wide are cut to lengths of two and one half inches. There is a total of thirty-two pieces. The kings are the only primary pieces that do not support a secondary piece. Except for the kings, all the primary pieces are drilled from the center of the bottom creating a hole that is three quarters of an inch wide and two inches high. Each primary piece has a carving on it that shows what piece it is as in traditional chess. FIG. 2, 23A, shows a primary piece that is a castle. FIG. 2, 23B, shows a hidden space that is the drilled out hole. The secondary pieces have two parts that are permanently glued together. The lower part is made by cutting wooden dowels to one and one quarter inches wide and one inch high. The upper part is made of wooden dowels, one half inch wide and one and three quarter inches long. The upper part is glued to the center of the lower part. FIG. 3 shows a secondary bishop. In FIG. 3, 24A, the top part is glued to the bottom part, 24B. The top parts of the secondary pieces are carved to show a piece as in traditional chess. There is no secondary king. In this game, there are a total of thirty-two primary pieces and thirty secondary pieces. Each player starts with a set of primary pieces which are one king, one queen, two bishops, two knights, two castles, and eight pawns. All of the primary pieces except for the king are capable of holding any one of the secondary pieces. Each player starts with a set of secondary pieces which are one queen, two bishops, two knights, two castles and eight pawns. All of the secondary pieces can fit into any of the primary pieces except for the primary king. When a primary piece and secondary piece is together the primary piece, FIG. 1, 23, rests on the bottom part of the secondary piece, FIG. 1, 24. The pieces are temporarily held in place by gravity and by the top of the secondary piece, FIG. 3, 24A, being inside of the primary piece, FIG. 2, 23B. When the secondary pieces are placed inside the primary pieces, the identities of the secondary pieces are kept secret from the opponent. When a primary piece and secondary piece are together and have to be moved on the board, it's done so by holding the bottom part of the secondary piece, FIG. 1, 24. When a primary piece is to be removed from a secondary piece it is done by holding down the bottom part of the secondary piece, FIG. 1, 24, and lifting up the primary piece, FIG. 1, 23.

Operation—FIGS. 1, 2, 3

The term traditional chess used in this application refers to the game of chess which is known to the general public. Chess to the Second Power uses the same type of playing board as traditional chess. In the new game, each player starts with a set of primary pieces, FIG. 2, 24 and a set of secondary pieces, FIGS. 3, 24A and 24B. Following, is how the game is played. Each piece in view has the same power as in traditional chess unless stated in the following rules. If there is a secondary piece inside a primary piece, the piece is moved according to the power of the primary piece. The following rules apply: there is a time limit of ten minutes for each player to strategically place the secondary pieces into the primary pieces. When doing this the players should include the placement of the secondary pieces into the overall game plan. The players have the option of placing any secondary piece into any primary piece, except for the primary king. The placement of the secondary pieces into the primary pieces is kept secret from each opponent. Each player should remember the locations of their secondary pieces. When all of the secondary pieces are in the primary pieces, they are placed on the board according to the rules of traditional chess. The identities of the primary pieces are in view FIG. 1, 23. Only the non-identifying part of the secondary piece is in view, FIG. 1, 24. When the ten minute time limit has run out both players should have all the pieces on the board with the secondary pieces inside their primary pieces. These pieces should be placed on the board according to the identities of the primary pieces: king, queen, two bishops, two knights, two castles, and eight pawns of the primary, according to the rules of traditional chess. If one player has the pieces correctly placed on the board and the other does not, the player with the pieces correctly placed on the board wins. If both players do not have their pieces set on the board when the time limit is up, the timer is set again allowing the players another ten minutes to place their secondary pieces inside of the primary pieces and put them on the board. With both players pieces on the board in there starting position it looks like the starting of a traditional game of chess.

During the game, when a primary piece has been taken, it is removed from the game. The secondary piece is taken out of the primary piece and placed in the same square it was occupying with the primary piece. The piece that took the primary piece returns to the square that it was in before advancing. It is the other players turn who is the player that had the primary piece taken. The castling rule is the same as in traditional chess. The En passant rule as in traditional chess applies to the primary and secondary pawns. Only the primary pawns have the option of moving forward one or two squares on the first move. When a primary or secondary pawn reaches the other side of the board as in traditional chess it has the option to be exchanged for any one piece of choice, not a primary with a secondary piece inside and not a king. If the pawn is a primary piece, its secondary piece is void and removed from the game. If the situation arises when a primary piece has been taken, revealing its secondary piece and by doing so puts the opponent in check, it is now check mate since it is the players turn that possesses the secondary pieces.

Conclusion, Ramification, and Scope

Accordingly, the reader will see that Chess to the Second Power is a game of strategy, skill, memorization, and luck. From the moment the timer is set until the end of the game, the players will have the opportunity to start with a basic game plan then change it as the playing field changes. Even though a good strategy is great, remembering the placement of the secondary pieces is vital. A player's skill level can determine the outcome. The added aspect of luck gives players of different skill levels a chance to win.

Although the preferred embodiment and operation have been described along with many specifications, these should not be interpreted as limiting the scope of the invention but merely providing illustrations of a simple embodiment and operation. For example, the playing pieces can have different shapes depicting their characters. The pieces can be of different sizes or colors and made from various materials. The game may be designed to include, in addition to a secondary piece, a third, fourth, fifth or up to an infinite amount of pieces in accordance to the nature of the game. The game can be played by drawing a board on a piece of paper, making paper squares for the playing pieces and writing a specific primary piece on one side and a specific secondary piece on the other side. Anything that can hold or hide some thing can be a primary piece. A secondary piece would be something that is inside or hidden by the primary piece in accordance with the rules and operation of Chess to the Second Power. The game may be made into a computer game. The game may be played on the internet or other means of game play. An alternative to the structure and play of the game can be to have the primary pieces made of a translucent material and the secondary pieces of a opaque material, allowing each player to view all the secondary pieces. A different way to play the game can be to write down the placement of the secondary pieces and either keep locations secret or exchange locations between players. Another way to play, can be for each player to set up their opponents secondary pieces so the players would know where their opponent's secondary pieces are but not their own. The way of hiding the secondary pieces should not be limited to any one way of hiding something. The game can be played by using the secondary pieces with any combination of secondary pieces. For example, each player may only have one secondary queen or a set of fifteen queens or five knights, five bishops and five castles or whatever is agreed upon before the game. Another possibility could be for a player to choose the secondary piece at the moment when a primary piece is taken. A different way of play can be to set the timer for one minute or whatever the players agree upon.

I claim:

1. A chess-like board game for two players, comprising:

first and second sets of primary playing pieces which are privileged, each set consisting of sixteen playing pieces defined as in traditional chess to include one king, one queen, two bishops, two knights, two castles and eight pawns;

first and second sets of secondary playing pieces which are privileged, each set consisting of fifteen playing pieces defined as in traditional chess to each include one queen, two bishops, two knights, two castles and eight pawns;

said first and second sets of primary playing pieces each being visually identifiable at all times, and with the exception of their respective kings, each including means for concealing via containment therein a selected one of the playing pieces of said first and second sets of secondary playing pieces, respectively, whereby one of said two players is assigned said first sets of primary and secondary playing pieces, and the other of said two players is assigned said second sets of primary and secondary playing pieces; and said concealing means of said first and second sets of primary playing pieces, with the exception of their respective kings, each include an internal cavity open at the bottom of each respective piece for receiving at least an identifying portion of any one of said playing pieces of said first and second sets of secondary playing pieces, respectively, each identifying portion being itself configured for fitting into any one of said internal cavities of said first and a second sets of primary playing pieces.

2. The game of claim 1, wherein each one of said first and second sets of primary and secondary playing pieces can be made from various materials, and can be of different size, style, shape, weight, and color.

3. The game of claim 1, provided via a media selected from the group consisting of a video game, an Internet game, any mechanical or electrical means, manual or automatic.

4. The game of claim 1, wherein said first and second primary and secondary playing pieces are provided as a card game.

* * * * *